United States Patent [19]

Obata et al.

[11] Patent Number: 4,555,314

[45] Date of Patent: Nov. 26, 1985

[54] TIN-LEAD ALLOY PLATING BATH

[75] Inventors: Keigo Obata, Himeji; Nobuyasu Dohi, Kobe; Yoshiaki Okuhama, Kobe; Seishi Masaki, Kobe; Yukiyoshi Okada, Kobe; Tadashi Yoshida, Kobe, all of Japan

[73] Assignees: Obata, Do-Hi, Daiwa Fine Chemicals Co. Ltd.; Ishihaa Chemical Co., Ltd., both of Kobe, Japan

[21] Appl. No.: 649,107

[22] Filed: Sep. 10, 1984

[51] Int. Cl.[4] ..... C25D 3/56; C25D 3/60

[52] U.S. Cl. ..... 204/44.4

[58] Field of Search ..... 204/44.4, 53, 54 R, 204/123

[56] References Cited

U.S. PATENT DOCUMENTS 4,459,185 7/1984 Obata et al. ..... 204/44.4

*Primary Examiner*—G. L. Kaplan

*Attorney, Agent, or Firm*—Seidel, Gonda, Goldhammer & Abbott

[57] ABSTRACT

A tin-lead alloy plating bath based on a principal plating bath comprising an alkanesulfonic or alkanolsulfonic acid and both bivalent tin and lead salts thereof is characterized by the addition of a guanamine compound having the general formula wherein $R_1$ and $R_2$, which may be the same or different, represent each a hydrogen atom, $C_{1-18}$ straight- or branched-chain alkyl radical, $C_{1-18}$ straight- or branched-chain alkoxy-lower alkyl radical, or a $C_{3-7}$ cycloalkyl radical, or $R_1$ and $R_2$ may combine to form a carbon cycle or hetero cycle, and A represents a lower alkylene radical.

6 Claims, 4 Drawing Figures

TIN-LEAD ALLOY PLATING BATH

BACKGROUND OF THE INVENTION

This invention relates to a sulfonic acid bath for tin-lead alloy plating capable of giving a deposit of stabilized tin-lead alloy composition.

For tin-lead alloy plating the use of commonly employed borofluoride baths has been subject to varied limitations due to the necessity of disposing of the resulting fluorine-containing wastewater. From this viewpoint tin-lead alloy plating baths using organic sulfonic acids of relatively low toxicity have recently been proposed. For example, Japanese Patent Application Nos. 176365/1982 and 55190/1983 disclosed that light-grayish, uniform, fine-grained electroplated coatings of tin-lead alloy could be obtained by adding to an organic sulfonic acid bath a nonionic surface active agent, such as an adduct of styrenated phenol with an alkylene oxide (e.g., polyoxyethylene tristyrylphenyl ether, PO-ETSPE) and an additive, such as a certain sulfanilic acid [e.g., N-(3-hydroxybutylidene)-p=sulfanilic acid, HBPSA] and/or a triazine [e.g., 2,4-diamino-6={2'-alkylimidazolyl(1')}ethyl-1,3,5-triazine, DAAIMET].

Tin-lead alloy (generally known as solder) plating is used extensively in light electric and electronic industries for joining metallic surfaces of components. For applications wherein occurrence of whiskers is undesirable, solder deposits containing from a few % to 20% of lead are applied. For applications wherein resistance to corrosion is required, solder deposits containing from 70% to 80% of lead are applied. Further, in fabricating printed-circuit boards, 60/40 eutectic solder deposits are applied as an etching resist.

Thus, since deposits having various compositions are required for tin-lead alloy plating according to their applications, it is ideal to always obtain deposits having a constant composition even if the current density changes from low to high.

For example, the printed-circuit boards with the tin-lead alloy are usually subjected to fusing, a treatment for removing overhangs and enhancing the solderability. The treatment, however, will give uneven, rough treated surfaces if the deposit produced by electroplating on the surface regions of the printed-circuit board is dissimilar in composition to that formed in through-hole plating with consequent difference in melting point between the two deposits. Therefore, in plating printed-circuit boards with a tin-lead alloy, it is necessary to assure deposition of a uniform composition throughout the surface regions and holes of the boards.

For the tin-lead alloy plating of printed-circuit boards semibright plating techniques are in wide use because in many cases brightness is not the first consideration and because the techniques permit smooth and even electroplating with good fusibility.

The plating baths described in the above-mentioned patent applications produce tin-lead alloy plates with fairly improved throwing power and fusing property. Under low current density conditions, however, they tend to increase the lead contents in the resulting deposits of tin-lead alloy, rendering it impossible to form plated coatings of the desired Sn/Pb ratio. In order to ensure high reliability required of printed-circuit boards, it is imperative that the Sn/Pb ratio in the deposits be stable, the deposits be improved in the fusing property and in stability against heat to be applied in subsequent process steps, and the plating bath be easy to control.

In view of the foregoing, we have investigated various addition agents. As a result, it has now been found that a certain group of guanamine compounds give tin-lead alloy plated coatings having a constant Sn/Pb ratio, under not only low current density conditions but even high current density conditions, the Sn/Pb ratio being substantially the same as that of the plating bath. It has also been found that these guanamine compounds yield plates possessing good throwing power, fusing property, and heat resistance without the addition of any such nonionic surface active agent or additive as referred to in the cited patent applications.

BRIEF SUMMARY OF THE INVENTION

Accordingly, it is an object of the present invention to provide a tin-lead alloy plating bath capable of giving a deposit of a constant Sn/Pb ratio under high as well as low current density conditions.

In accomplishing these objects, there has been provided in accorance with the present invention a tin-lead alloy plating bath consisting essentially of tin and lead salts of an organic sulfonic acid and a free organic sulfonic acid, characterized by the addition of at least one guanamine compound.

Guanamine compounds which may be employed in the invention have the general formula

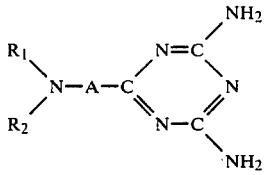

wherein $R_1$ and $R_2$, which may be the same or different, represent each a hydrogen atom, $C_{1-18}$ straight- or branched-chain alkyl radical, $C_{1-18}$ straight- or branched-chain alkoxy-lower alkyl radical, or a $C_{3-7}$ cycloalkyl radical, or $R_1$ and $R_2$ may combine to form a carbon cycle or hetero cycle, and A represents a lower alkylene radical.

DETAILED DESCRIPTION

Figure 1:
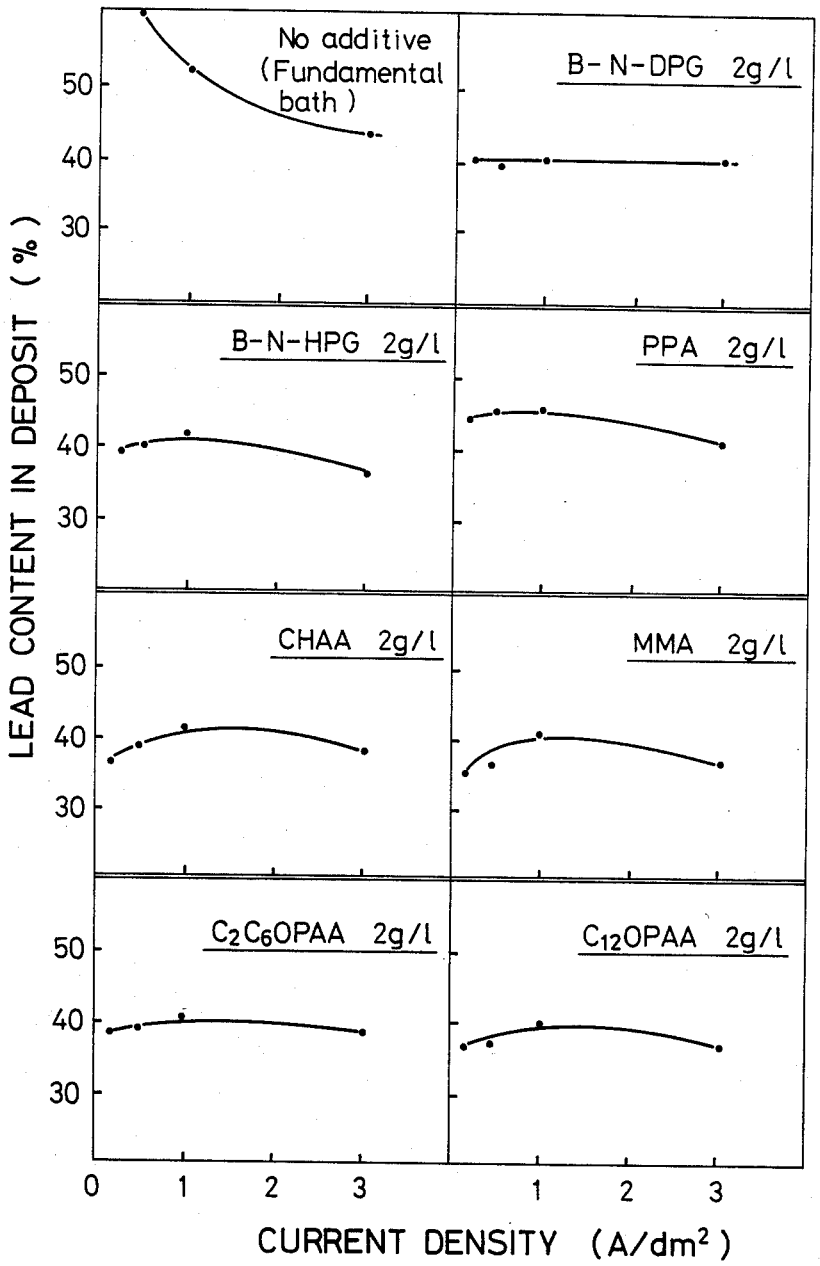
FIG. 1 is a graphic representation of the relations between varied current densities for tin-lead alloy plating using various guanamine compounds and the lead contents in the resulting deposits.

Desirable guanamine compounds for the purposes of the invention include those of the above-mentioned general formula in which either $R_1$ or $R_2$ represents a hydrogen atom and the other represents a $C_{5-14}$ alkyl (e.g., pentyl, hexyl, heptyl, octyl, nonyl, decyl, or dodecyl), $C_{5-14}$ alkoxy-ethyl or alkoxy-propyl (e.g., pentyloxy-, hexyloxy-, peptyloxy-, octyloxy-, 2-ethyl-hexyloxy-, or decyloxy-ethyl or -propyl), or cyclohexyl radical, and those in which $R_1$ and $R_2$ combine to form a piperidine, morpholine, or piperazine cycle. A desirable lower alkylene radical is ethylene or propylene radical.

Examples of usable guanamine compounds are mentioned in Table 1 to be given later.

Among particularly desirable ones are those in which either $R_1$ or $R_2$ of the general formula represents a $C_{1-18}$ alkoxy-lower alkyl radical, e.g., β-N-(2-ethylhexyloxy-propylamino)propioguanamine.

A guanamine compound in accordance with the invention is added in an amount of 0.01 to 30 g, preferably 0.1 to 10 g, per liter of the plating solution.

The principal plating solution according to the invention consists basically of at least one of organic sulfonic, alkanesulfonic, and alkanolsulfonic acids and a tin salt and a lead salt of such a sulfonic acid.

The alkane- or alkanolsulfonic acid employed has the general formula $$R\text{-}SO_3H$$

wherein R is a $C_{1-12}$ alkyl radical, or $$HO\text{-}R\text{-}SO_3H$$

wherein R is a $C_{1-12}$ alkyl radical and OH may be located in any desired position.

Examples of alkanesulfonic acids are methane-, ethane-, propane-, 2-propane-, butane-, 2-butane-, pentane-, hexane-, decane-, and dodecanesulfonic acids. These alkanesulfonic acids may be used singly or as a mixture of two or more.

Examples of alkanolsulfonic acids are isethionic acid and 2-hydroxyethane-1-, 2-hydroxypropane-1-, 1-hydroxypropane-2-, 3-hydroxypropane-1-, 2-hydroxybutane-1-, 4-hydroxybutane-1-, 2-hydroxypentane-1-, 2-hydroxyhexane-1-, 2-hydroxydecane-1-, and 2-hydroxydodecane-1-sulfonic acids. These hydroxyl-containing alkanesulfonic acids may be employed alone or in a combination of two or more.

The total concentration of tin and lead salts is, in terms of the respective metallic elements, in the range of 0.5–200 g/l, preferably in the range of 10–100 g/l. The concentration of the free alkanesulfonic or alkanolsulfonic acid present in the plating bath is 30–400 g/l, preferably 70–150 g/l. In accordance with the invention, a plated coating having substantially the same Sn/Pb ratio as that of the plating bath can be obtained under a broad range of current densities including low current density conditions.

The tin-lead alloy plating bath of the invention may contain a surface active agent, especially a nonionic one, which improves the dispersibility of the bath and allows the bath to form an adherent, smooth plated coating. Nonionic surface active agents have proved effective in enhancing the throwing power in electroplating at a low current density.

The nonionic surface active agents that may be effectively utilized in the plating bath of the invention have the general formula (I)

$$RA-(CH_2-\overset{\overset{R'}{|}}{C}H-O)_m-(CH_2-\overset{\overset{R''}{|}}{C}H-O)_nH \qquad (I)$$

wherein RA represents a residue of a $C_{8-20}$ alkanol, $C_{1-25}$ alkylphenol, $C_{1-25}$ alkyl-β-naphthol, $C_{3-22}$ fatty acid amide, $C_{1-25}$ alkoxylated phosphoric acid, $C_{8-22}$ higher-fatty-acid-esterified sorbitan ester, or of a styrenated phenol (in which the hydrogen of the phenol nucleus may be substituted with a $C_{1-4}$ alkyl or phenyl radical, R′ and R″ represent each a hydrogen atom or methyl radical with the proviso that when R′ is a hydrogen atom R″ is a methyl radical or vice versa, and m and n represent each an integer of 1 to 30.

Such a useful nonionic surface active agent of the formula (I) for the plating bath of the invention may be one well known in the art. It may be prepared in the usual manner, for example, by addition condensation of a $C_{8-22}$ higher alcohol, alkylphenol, alkyl-β-naphthol, $C_{3-22}$ fatty acid amide, alkoxylated phosphoric acid, $C_{8-22}$ higher-fatty-acid-esterified sorbitan or styrenated phenol with ethylene oxide (or propylene oxide) and further with propylene oxide (or ethylene oxide).

Among the higher alcohols that can be addition condensed with ethylene oxide or propylene oxide are octanol, decanol, lauryl alcohol, tetradecanol, hexadecanol, stearyl alcohol, eicosanol, cetyl alcohol, oleyl alcohol, and docosanol. Useful alkylphenols are mono-, di-, or trialkylsubstituted phenols, e.g., p-butylphenol, p-isooctylphenol, p-nonylphenol, p-hexylphenol, 2,4-dibutylphenol, 2,4,6-tributylphenol, p-dodecylphenol, p-laurylphenol, and p-stearylphenol. Alkyl radicals for alkyl=β-naphthols include methyl, ethyl, propyl, butyl, hexyl, octyl, decyl, dodecyl, and octadecyl. They may assume any desired position in the naphthalene nucleus. Examples of fatty acid amides are the amides of propionic, butyric, caprylic, capric, lauric, myristic, palmitic, stearic, and behenic acids. Alkoxylated phosphoric acids are represented by the formula

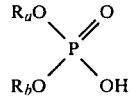

wherein $R_a$ and $R_b$ are $C_{1-25}$ alkyl radicals, and either of them may be a hydrogen atom. They are obtained by esterifying one or two of the hydroxyl groups of phosphoric acid with an alcohol of a suitable chain length ($C_{1-25}$). Usable styrenated phenol is a mono-, di-, or tristyrenated phenol having the formula

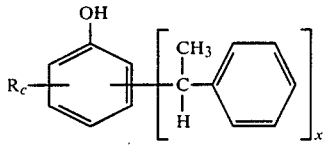

wherein $R_c$ is hydrogen, $C_{1-4}$ alkyl radical, or phenyl radical, and x has a number of 1 to 3. The hydrogen in the phenol nucleus may be substituted with an alkyl or phenyl radical. A suitable example is a mono-, di-, or tri-styrenated phenol, mono- or distyrenated cresol, or mono- or distyrenated phenylphenol. It may be a mixture of these phenols. Typical sorbitans esterified with higher fatty acids are mono-, di-, or triesterified 1,4-, 1,5-, and 3,6-sorbitans, e.g., sorbitan monolaurate, sorbitan monopalmitate, sorbitan monostearate, sorbitan oleate, sorbitan dilaurate, sorbitan dipalmitate, sorbitan distearate, sorbitan dioleate, and sorbitan mixed fatty acid esters.

The afore-mentioned nonionic surface active agents may be used singly or in combination.

The concentration of the nonionic surface active agent to be employed is usually in the range of 0.01–50 g/l, preferably in the range of 0.03–20 g/l.

To improve the smoothness of the plate surface, the plating bath of the invention may contain one of certain smoothening or leveling additives. Such an additive is used together with the nonionic surface active agent to achieve a synergetically favorable effect. The leveling additives that have proved particularly effective include those having the formulas (A) and (B).

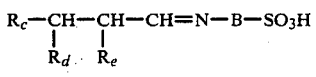

(A)

wherein $R_c$ is hydrogen, $C_{1-4}$ alkyl radical, or phenyl radical, $R_d$ is hydrogen or hydroxyl group, B is a $C_{1-4}$ alkylene, phenylene, or benzyl radical, and $R_e$ is hydrogen or $C_{1-4}$ alkyl radical.

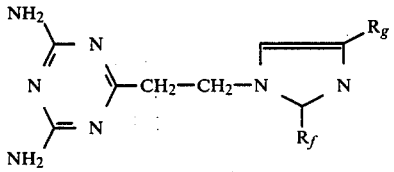

(B)

wherein $R_f$ and $R_g$ are each $C_{1-18}$ alkyl radical.

Of these leveling additives, particularly desirable are N-(3-hydroxybutylidene)-p-sulfanylic acid, n-butylidenesulfanilicacid, N-cinnamoylidenesulfanilic acid, 2,4-diamino-6-[2'-methylimidazolyl(1')]ethyl-1,3,5-triazine, 2,4-diamino-6-[2'-ethyl-4-methylimidazolyl(1')]ethyl-1,3,5-triazine, 2,4-diamino-6-[2'-undecylimidazolyl(1')]ethyl-1,3,5-triazine, and the like.

The concentration of such a leveling additive ranges from 0.01 to 30 g/l, preferably from 0.03 to 5 g/l.

The concentrations of the individual constituents of the plating bath according to the present invention may be optionally chosen depending on whether the plating is performed by the barrel, rack, high-speed continuous, or through-hole plating technique.

The plating bath of the invention is capable of producing uniform, dense plated coatings at a wide range of current densities.

The present invention will now be illustrated by the following examples showing typical plating bath compositions and operating conditions. It should be noted, however, that the invention is not limited thereto but may be variously embodied with free modifications of the bath composition and plating conditions to realize the aforedescribed objects.

EXAMPLE 1

In this example various guanamine compounds listed in Table 1 were added to divided portions of a tin-lead alloy plating bath of a fundamental bath composition shown in Table 2, and plating was carried out on copper pieces.

TABLE 1

| No. | Compound | Abridged | Chemical formula |
|---|---|---|---|
| 1 | β-N—Dodecylamino-propioguanamine | β-N—DPG | 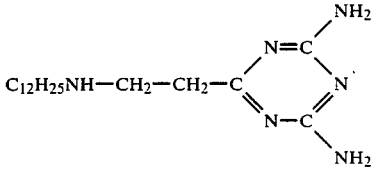 |
| 2 | β-N—Hexylamino-propioguanamine | β-N—HPG | 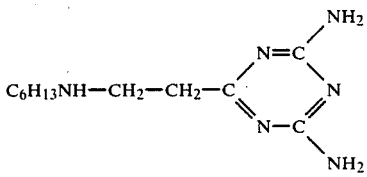 |
| 3 | Piperidine-propioguanamine | PPA | 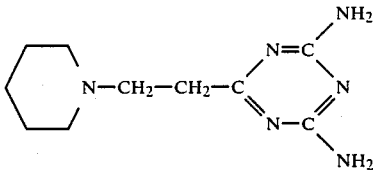 |
| 4 | Cyclohexylamino-propioguanamine | CHAA | 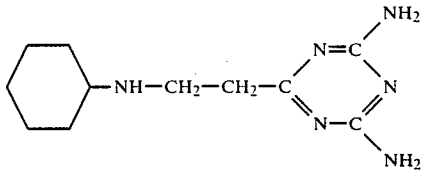 |

TABLE 1-continued

| No. | Compound | Abridged | Chemical formula |
|---|---|---|---|
| 5 | Morpholine-propioguanamine | MMA | 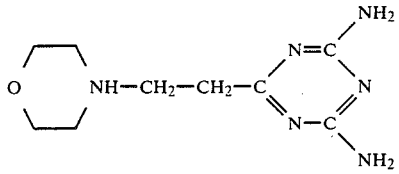 |
| 6 | β-N—(2-Ethylhexyl-oxypropylamino)-propioguanamine | $C_2C_6OPAA$ | 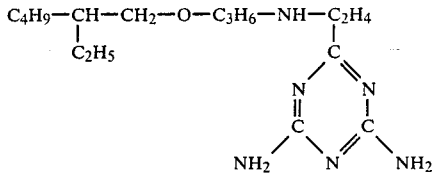 |
| 7 | β-N—(Lauryloxy-propylamino)-propioguanamine | $C_{12}OPAA$ | 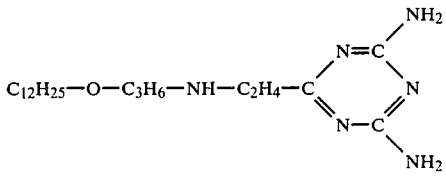 |

TABLE 2

| | |
|---|---|
| Stannous 2-hydroxypropanesulfonate (as a bivalent tin) | 12 g/l |
| Lead 2-hydroxypropanesulfonate (as a bivalent lead) | 8 g/l |
| Free methanesulfonic acid | 100 g/l |
| POETSPE | 5 g/l |
| HBPSA | 0.1 g/l |
| DAAIMET | 0.7 g/l |

The plating was performed by galvanostatic electrolysis with 600 coulombs at a predetermined current density, using a copper wire, 2 mm dia. and 250 mm long, as the cathode and moving it at a rate of 2 m/min. The individual deposits thus obtained were dissolved in 6 N HCl and their lead contents (in percent by weight) were determined by atomic absorption analysis. The results are shown in FIG. 1.

EXAMPLE 2

The test specimens tin-lead alloy plated from the baths prepared by adding the stabilizers of Table 1 to the basic bath composition of Table 2 were subjected to infrared fusing at varied temperatures. The surface conditions treated at the different temperatures were evaluated. The plating was carried out under a relatively low current density condition (0.25 $A/dm^2$) to a plate thickness of 10 μm. A constant heating time of 3 seconds was used for fusing at each predetermined temperature.

For the fusing tests a near-infrared-ray planar heater, automatic SCR power controller, and temperature controller were used. The plated test piece was set on a copper sheet for temperature control connected to an iron-constantan thermocouple, and was irradiated with infrared rays from the direction perpendicular to the piece.

Figure 2:
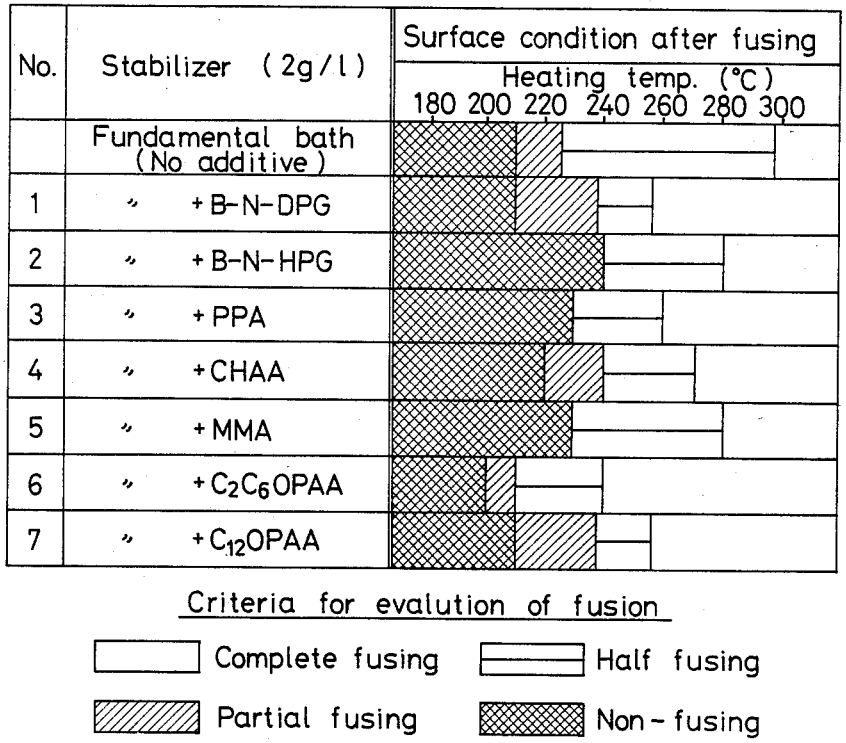
FIG. 2 is a graphic representation of the surface conditions after fusing of the tin-lead alloy plates in the embodiment of the invention.

The test results are shown in FIG. 2.

As a criterion of the fusing property, complete fusing at a relatively low temperature is desired. The addition of the stabilizer, whichever was employed, made it possible for the bath to yield a completely fusible surface as compared with the surface from the nonstabilized bath of the fundamental composition.

EXAMPLE 3

A plated coating of tin-lead alloy was formed from a bath of the composition comprising

Figure 3:
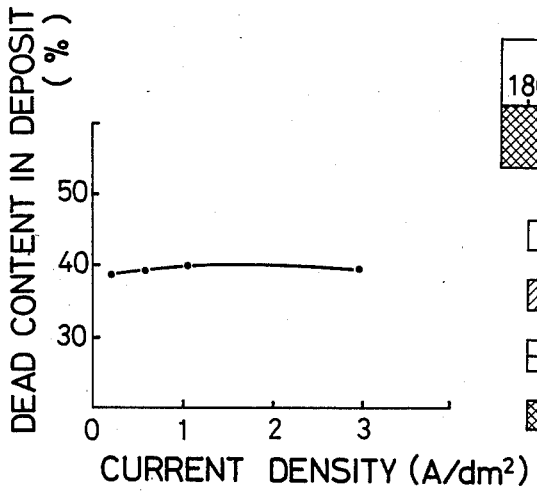
FIG. 3 is a curve showing the relation between the current density and the lead content in the deposit in another embodiment of the invention.
Figure 4:
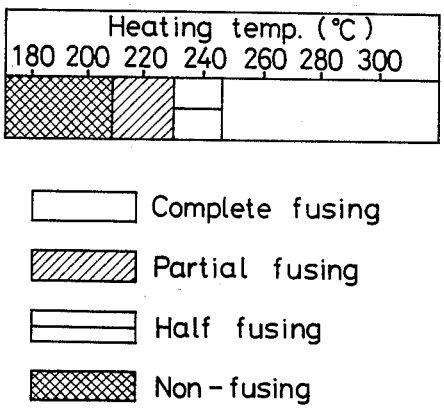
FIG. 4 is a graphic representation of the surface condition after fusing of the tin-lead alloy plate in the above embodiment of the invention.

| | |
|---|---|
| stannous 2-hydroxypropanesulfonate (as a bivalent tin) | 12 g/l |
| lead 2-hydroxypropanesulfonate (as a bivalent lead) | 8 g/l |
| free methanesulfonic acid | 100 g/l |
| $C_2C_6OPAA$ | 2 g/l |

and the relation between the current density and the lead content in the resulting deposit was determined and further the fusing property of the plated coating was evaluated. The results are given, respectively, in FIGS. 3 and 4. With the $C_2C_6OPAA$ alone the plate composition and the fusing properties were both stable.

EXAMPLE 4

The stabilzers of Table 1 were added to divided portions of a fundamental plating bath of the composition shown in Table 3. The alloy compositions of the tin-lead alloy plated coatings thus obtained from the individual plating baths were analyzed in the same way as described in Example 1. The results are given in Table 4.

TABLE 3

| | |
|---|---|
| Stannous ethanesulfonate (as a bivalent tin) | 18 g/l |
| Lead ethanesulfonate (as a bivalent lead) | 2 g/l |
| Free ethanesulfonicacid | 100 g/l |
| POETSPE | 5 g/l |
| HBPSA | 0.1 g/l |
| DAAIMET | 0.07 g/l |

TABLE 4

| Guanamine additive | Lead content in deposit (wt %) Current density 0.25 A/dm² | 5 A/dm² |
|---|---|---|
| No additive | 25.4 | 15.0 |
| CHAA 1 g/l | 9.5 | 12.1 |
| $C_2C_6$OPAA 2 g/l | 11.2 | 10.5 |

EXAMPLE 5

The stabilizers of Table 1 were added to divided portions of a fundamental plating bath of the composition shown in Table 5. The alloy compositions of the tin-lead alloy plated coatings thus obtained from the individual plating baths were analyzed in the same way as described in Example 1. The results are given in Table 6.

TABLE 5

| | |
|---|---|
| Stannous 2-hydroxypropanesulfonate (as a bivalent tin) | 4 g/l |
| Lead 2-hydroxypropanesulfonate (as a bivalent lead) | 16 g/l |
| Free 2-hydroxypropanesulfonic acid | 80 g/l |
| POETSPE | 3 g/l |
| HBPSA | 0.2 g/l |
| DAAIMET | 1 g/l |

TABLE 6

| Guanamine additive | Lead content in deposit (wt %) Current density 0.25 A/dm² | 4 A/dm² |
|---|---|---|
| No additive | 98.2 | 85.3 |
| β-N—HPG 5 g/l | 79.6 | 81.4 |
| $C_{12}$OPAA 2 g/l | 78.3 | 80.6 |

EXAMPLE 6

The stabilizers of Table 1 were added to divided portions of a fundamental plating bath of the composition shown in Table 7. The alloy compositions of the tin-lead alloy plated coatings thus obtained from the individual plating baths were analyzed in the same way as described in Example 1. The results are given in Table 8.

TABLE 7

| | |
|---|---|
| Stannous 2-hydroxyethanesulfonate (as a bivalent tin) | 54 g/l |
| Lead 2-hydroxyethanesulfonate (as a bivalent lead) | 6 g/l |
| Free 2-hydroxyethanesulfonic acid | 120 g/l |
| POETSPE | 5 g/l |
| HBPSA | 1 g/l |
| DAAIMET | 2 g/l |

TABLE 8

| Guanamine additive | Lead content in deposit (wt %) Current density 0.5 A/dm² | 30 A/dm² |
|---|---|---|
| No additive | 24.2 | 12.7 |
| $C_2C_6$OPAA 2 g/l | 10.7 | 11.5 |

EXAMPLE 7

The stabilizers of Table 1 were added to divided portions of a fundamental plating bath of the composition shown in Table 9. The alloy compositions of the tin-lead alloy plated coatings thus obtained from the individual plating baths were analyzed in the same way as described in Example 1. The results are given in Table 10.

TABLE 9

| | |
|---|---|
| Stannous methanesulfonate (as a bivalent tin) | 36 g/l |
| Lead methanesulfonate (as a bivalent lead) | 24 g/l |
| Free methanesulfonic acid | 80 g/l |
| POETSPE | 10 g/l |
| HBPSA | 0.2 g/l |
| DAAIMET | 0.7 g/l |

TABLE 10

| Guanamine additive | Lead content in deposit (wt %) Current density 0.25 A/dm² | 3.0 A/dm² |
|---|---|---|
| No additive | 75.7 | 43.7 |
| β-N—DPG 6 g/l | 36.7 | 38.0 |
| MMA 6 g/l | 37.1 | 42.0 |
| PPA 6 g/l | 41.2 | 45.2 |

EXAMPLE 8

The alloy compositions of tin-lead alloy plated coatings, produced from different plating baths prepared by adding the stabilizers of Table 1 to portions of the fundamental plating bath shown in Table 11, were determined by the same method as used in Example 1. Table 12 summarizes the results.

TABLE 11

| | |
|---|---|
| Stannous propanesulfonate (as a bivalent tin) | 24 g/l |
| Lead propanesulfonate (as a bivalent lead) | 16 g/l |
| Free propanesulfonic acid | 100 g/l |
| POETSPE | 2 g/l |
| HBPSA | 0.1 g/l |
| DAAIMET | 0.07 g/l |

TABLE 12

| Guanamine additive | Lead content in deposit (wt %) Current density 0.25 A/dm² | 3.0 A/dm² |
|---|---|---|
| No additive | 70.8 | 42.1 |
| β-N—DPG 0.5 g/l | 39.5 | 41.3 |
| MMA 0.5 g/l | 42.8 | 44.1 |
| $C_2C_6$OPAA 0.5 g/l | 36.5 | 40.3 |

What is claimed is:

1. A tin-lead alloy plating bath based on a principal plating bath comprising an alkanesulfonic or alkanolsulfonic acid and both bivalent tin and lead salts thereof, characterized by the addition of a guanamine compound having the general formula

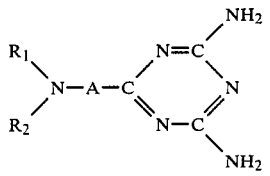

wherein $R_1$ and $R_2$, which may be the same or different, represent each a hydrogen atom, $C_{1-18}$ straight- or branched-chain alkyl radical, $C_{1-18}$ straight- or branched-chain alkoxy-lower alkyl radical, or a $C_{3-7}$ cycloalkyl radical, or $R_1$ and $R_2$ may combine with the nitrogen atom to form a piperidine, morpholine or piperazine cycle, and A represents a lower alkylene radical.

2. A plating bath according to claim 1 characterized in that said guanamine compound is used at a concentration of 0.01 to 3 g per liter of the plating solution.

3. A plating bath according to claim 1 characterized in that said alkane- or alkanolsulfonic acid has, respectively, the general formula $$R\text{-}SO_3H$$

wherein R is a $C_{1-12}$ alkyl radical, or $$HO\text{-}R\text{-}SO_3H$$

wherein R is a $C_{1-12}$ alkyl radical and OH may be located in any desired position.

4. A plating bath according to claim 1 characterized in that said tin and lead salts of an alkanesulfonic or alkanolsulfonic acid are used at a concentration, in terms of the respective metallic elements, of 0.5 to 200 g per liter of the bath.

5. A plating bath according to claim 1 characterized in that the concentration of the free alkanesulfonic or alkaanolsulfonic acid is 30–400 g per liter of the bath.

6. A plating bath according to claim 1 which further comprises a nonionic surface active agent and/or a leveling additive.

* * * * *